US007954652B2

(12) United States Patent
Kao

(10) Patent No.: US 7,954,652 B2
(45) Date of Patent: Jun. 7, 2011

(54) TOOL RACK

(76) Inventor: Jui-Chien Kao, Tali (TW)

( * ) Notice: Subject to any disclaimer, the term of this patent is extended or adjusted under 35 U.S.C. 154(b) by 0 days.

(21) Appl. No.: 12/555,807

(22) Filed: Sep. 9, 2009

(65) Prior Publication Data

US 2011/0056897 A1 Mar. 10, 2011

(51) Int. Cl.
*A47F 7/00* (2006.01)

(52) U.S. Cl. ..... 211/70.6; 211/94.01; 211/106.01; 248/303

(58) Field of Classification Search ..... 211/94.01, 211/70.6, 106.01; 248/215, 223.4, 225.11, 248/303, 304, 307; 206/349, 372, 373, 376, 206/378

See application file for complete search history.

(56) References Cited

U.S. PATENT DOCUMENTS 2,754,974 A * 7/1956 Larson ..... 211/70.6
7,198,158 B2 * 4/2007 Kao ..... 211/70.6
7,258,239 B2 * 8/2007 Kao ..... 211/70.6
7,284,671 B1 * 10/2007 Doscher ..... 211/59.1
2007/0017886 A1 * 1/2007 Kao ..... 211/94.01
2007/0210021 A1 * 9/2007 Whitehead et al. ..... 211/70.6
2008/0023420 A1 * 1/2008 Kao ..... 211/70.6
2008/0041800 A1 * 2/2008 Kao ..... 211/70.6

* cited by examiner

*Primary Examiner* — Korie Chan
(74) *Attorney, Agent, or Firm* — Hershkovitz & Associates, LLC; Abraham Hershkovitz

(57) ABSTRACT

A tool rack has a slide rack and multiple hangers. The slide rack has a baseboard and an elongated rail protruding from the baseboard. The multiple hangers are slidably mounted on the rail of the slide rack, and each has a hanging body and a hanging shaft. The hanging body is made by injection molding and slidably connected to the rail of the slide rack and has a protruding side and a connecting mount. The connecting mount protrudes from the protruding side of the hanging body and has an inserting hole formed in the connecting mount. The hanging shaft is metal and has an inserting end and a bent end. The inserting end has an engaging head mounted in the inserting hole and surrounded by the connecting mount. The bent end is opposite to the inserting end and bent upward for hanging a hand tool.

12 Claims, 18 Drawing Sheets

TOOL RACK

BACKGROUND OF THE INVENTION

1. Field of the Invention

The present invention relates to a tool rack, and more particularly to a tool rack with multiple hangers of a same size and having sufficient strength to hold hand tools of different sizes.

2. Description of the Prior Art

A conventional tool rack is used to hang and display hand tools, such as box-end wrenches, adjustable wrenches or the like, and has a rail and multiple hangers. The rail is elongated and has a longitudinal axis. The hangers are slidably attached to the rail along the longitudinal axis. Each hanger has a hook for hanging a hand tool. To hang hand tools of different sizes, the hooks of the hangers must be different lengths.

Furthermore, because the hangers are made by injection molding, the hangers have to be made of different lengths with increased diameter for sufficient the strength to hang the hand tools of different sizes. Therefore, the hangers of different sizes require a lot of material for production so increasing manufacturing costs.

To overcome the shortcomings, the present invention provides a tool rack to mitigate or obviate the aforementioned problems.

SUMMARY OF THE INVENTION

The main objective of the invention is to provide a tool rack with multiple hangers of a same size and having sufficient strength to hold hand tools of different sizes.

The tool rack has a slide rack and multiple hangers. The slide rack has a baseboard and an elongated rail and protruding from the baseboard. The multiple hangers are slidably mounted on the rail of the slide rack, and each has a hanging body and a hanging shaft. The hanging body is made by injection molding and is slidably connected to the rail of the slide rack and has a protruding side and a connecting mount. The connecting mount protrudes from the protruding side of the hanging body and has an inserting hole formed in the connecting mount. The hanging shaft is metal and has an inserting end and a bent end. The inserting end has an engaging head mounted in the inserting hole and surrounded by the connecting mount. The bent end is opposite to the inserting end and has a hook bent upward for hanging a hand tool.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
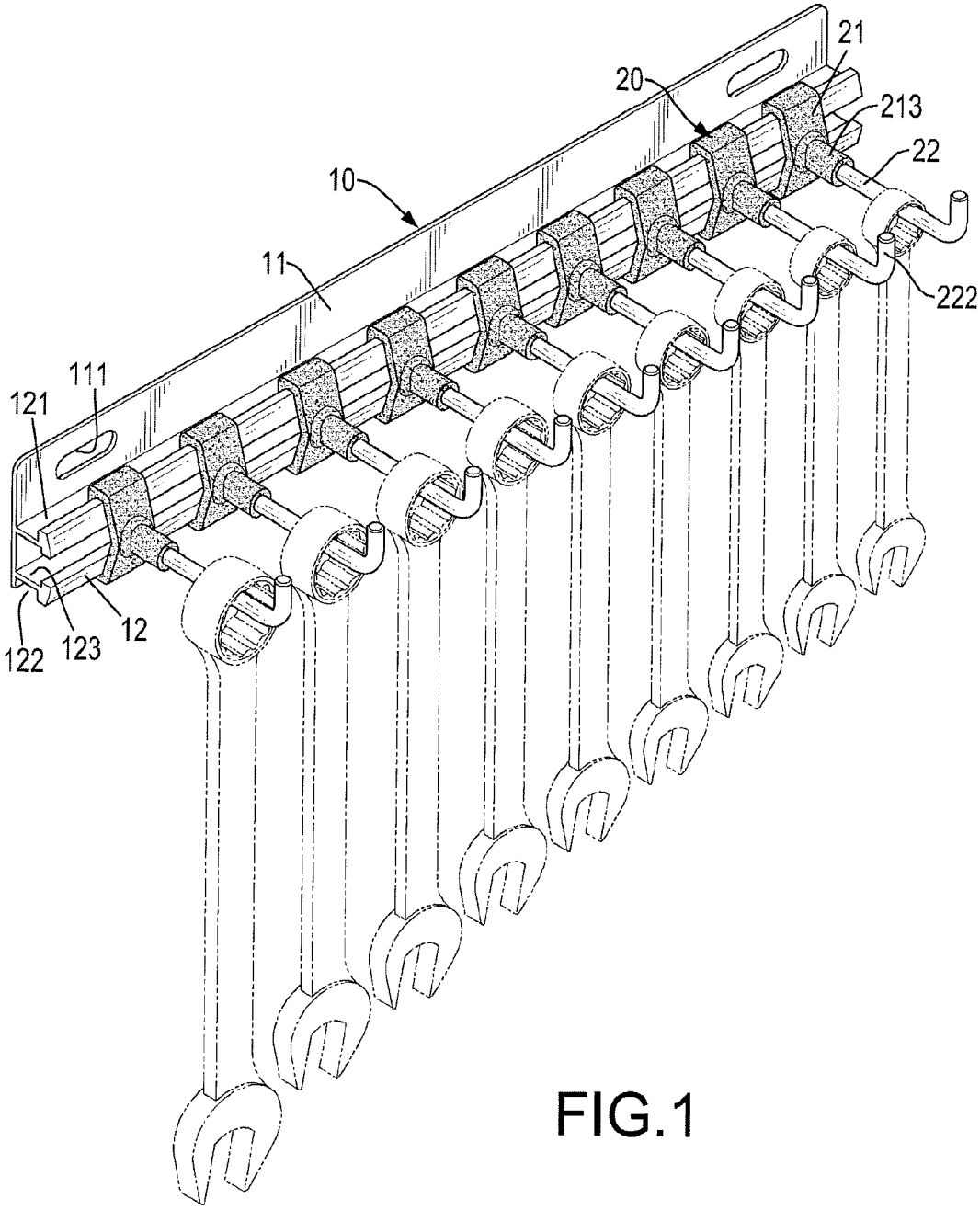
FIG. 1 is a perspective view of a first embodiment of a tool rack in accordance with the present invention.
Figure 2:
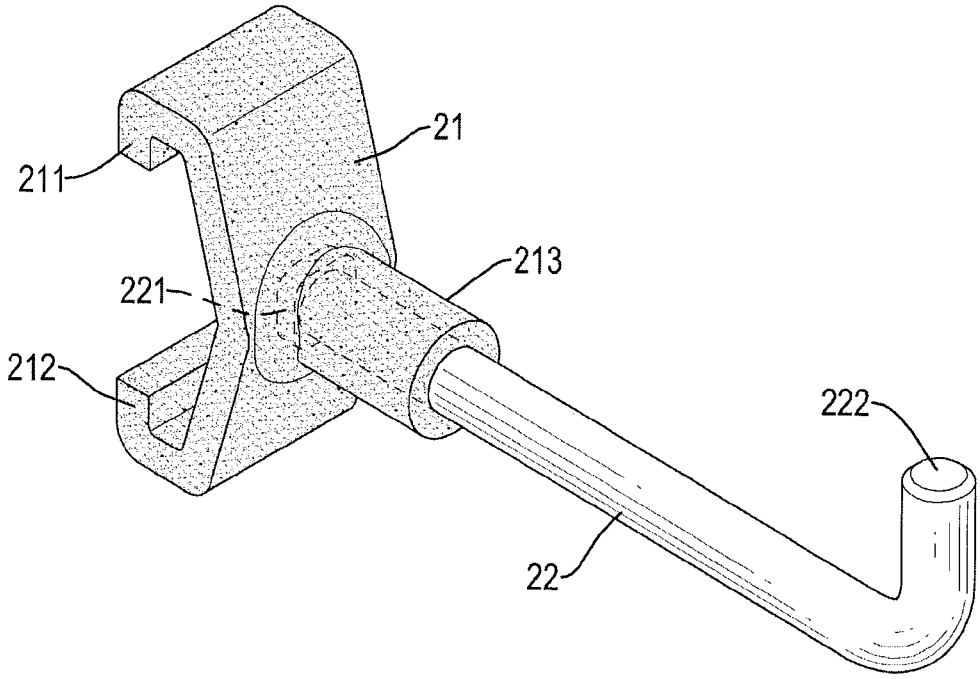
FIG. 2 is a perspective view of a hanger of the tool rack in FIG. 1.
Figure 3:
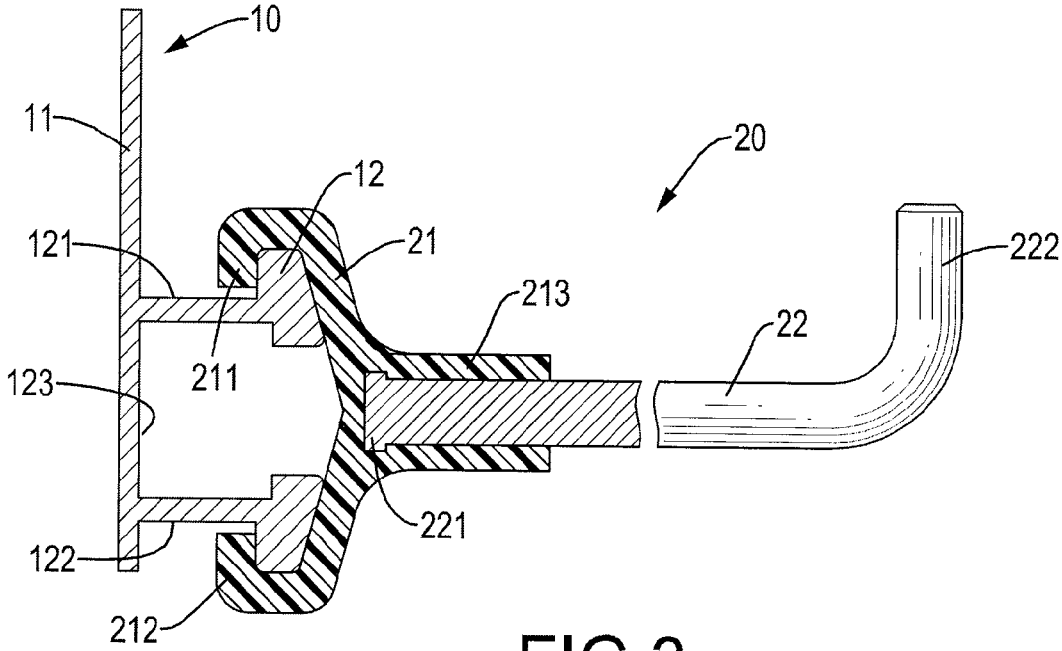
FIG. 3 is a side view in partial section of the tool rack in FIG. 1.

With reference to FIGS. 1 to 4, a first embodiment of a tool rack in accordance with the present invention has a slide rack (10) and multiple hangers (20). The slide rack (10) is an elongated board and has a baseboard (11) and a rail (12). The baseboard (11) is may be rectangular, and has a rear side, a front side, an upper section, a lower section, two ends and two holes (11) respectively formed through and defined near the ends at the upper section of the baseboard (11). The holes (111) are fitted with fasteners, such as screws or bolts to attach the slide rack (10) to a tool board (40), a wall or the like.

The rail (12) is elongated, is formed on and protrudes perpendicularly from the front side of the baseboard (11), and has two arms (121,122) and a space (123). The arms (121, 122) are parallel to each other and may protrude from the lower section of the baseboard (11), each arm (121,122) has an engaging end and an engaging rib. The engaging ends of the arms (121,122) are opposite to the baseboard (11) and each engaging end has a thickness. The engaging ribs are respectively formed on the engaging ends of the arms (121, 122) and each engaging rib has a thickness thicker than the thickness of the engaging end of the arm (121, 122). The space (123) is defined between the arms (121,122) to allow the arms (121,122) of the rail (12) to be compressed toward each other.

Each hanger (20) is slidably mounted on the rail (12) of the slide rack (10), and has a hanging body (21) and a hanging shaft (22). The hanging body (21) is made by injection molding, is connected slidably to the rail (12) of the slide rack (10) and has two hooking arms (211,212), a protruding side and a connecting mount (213).

The hooking arms (211,212) respectively and slidably engage the engaging ribs of the arms (121,122) of the rail (12) to hold the hanging body (21) movably on the slide rack (10). The protruding side of the hanging body (21) is defined on the hanging body (21) opposite to the slide rack (10) and may be an outer side of the hanging body (21). The connecting mount (213) protrudes from the protruding side of the hanging body (21) and may be a hollow rod and extend an axial length along the rod, and has an inserting hole and an engaging recess. The inserting hole is a blind hole formed in the connecting mount (213). The engaging recess is rectangular and formed in the connecting mount (213) and communicates with the inserting hole of the connecting mount (213).

The hanging shaft (22) is metal and has an inserting end and a bent end. The inserting end of the hanging shaft (22) is mounted in the inserting hole and surrounded and covered completely by the connecting mount (213), and has an engaging head (221). The engaging head (221) is mounted on the inserting end of the hanging shaft (22), is shaped as a cube or cuboid, and has an outer diameter larger than a diameter of the inserting end of the holding shaft (22). The engaging head (221) is mounted in the engaging recess of the connecting mount (213) and provide an engaging effect for the hanging shaft (22) connected securely to the hanging body (21) to prevent movement or rotation of the hanging shaft (22) relative to the hanging body (21). The bent end of the hanging shaft (22) is opposite to the inserting end, and has a hook (222) bent upward for hanging a hand tool.

Figure 4:
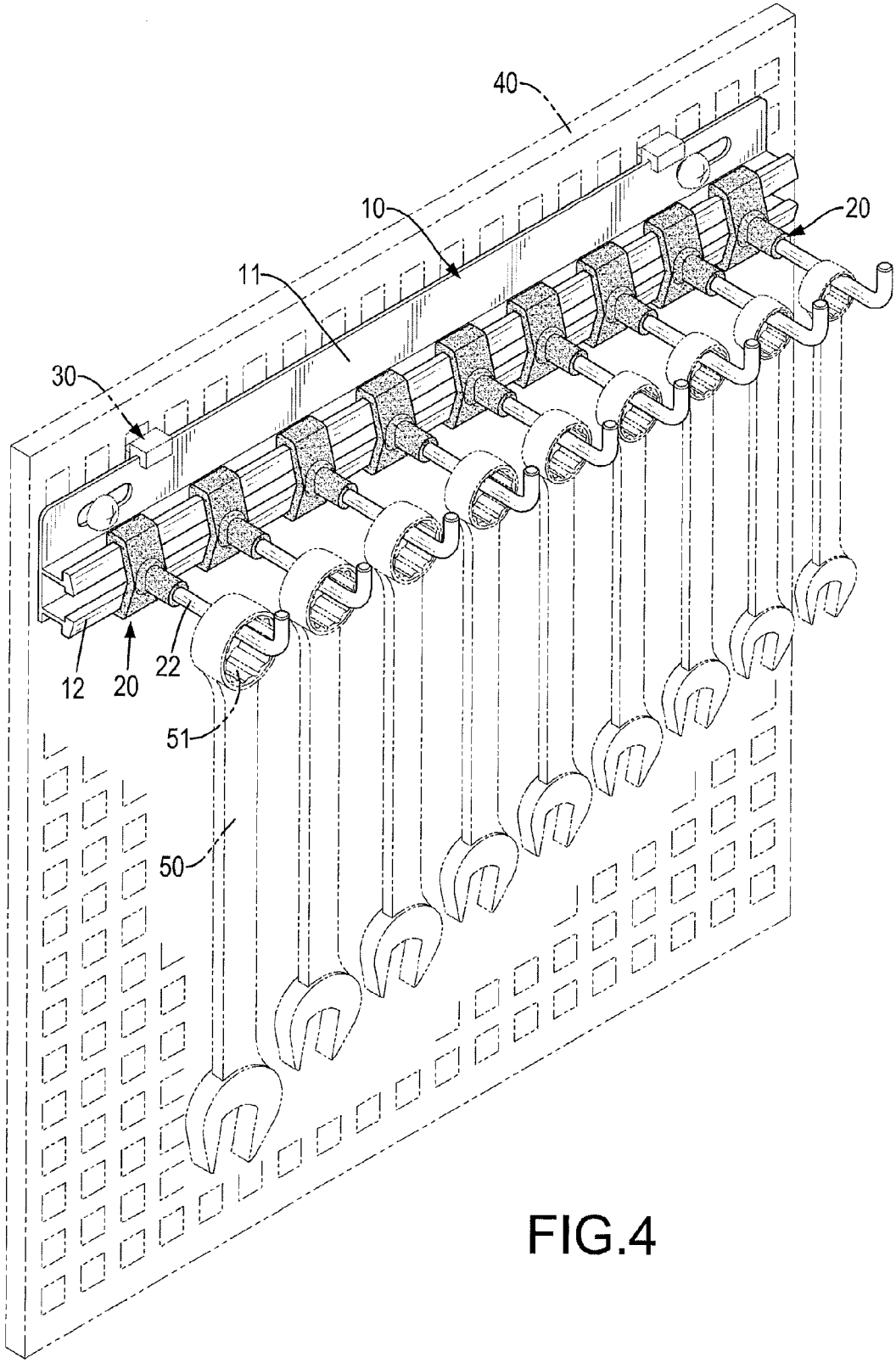
FIG. 4 is a perspective view of the tool rack in FIG. 1 shown attached to a tool board.
Figure 5:
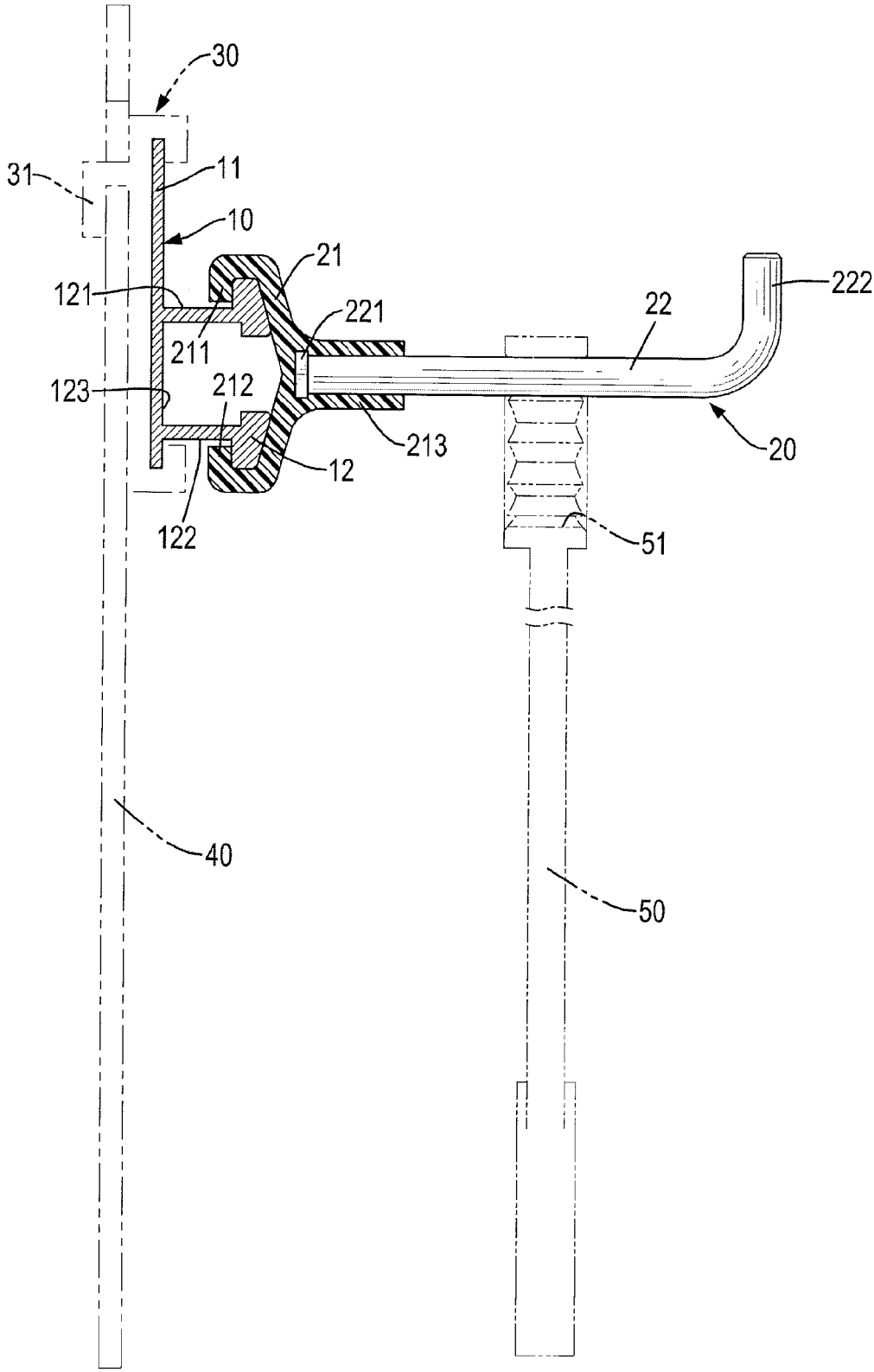
FIG. 5 is a side view in partial section of the tool rack in FIG. 4.

With reference to FIG. 4 and FIG. 5, the slide rack (10) may be attached to the tool board (40) by two connectors (30). The connectors (30) are respectively mounted on the rear side of and clamp on the upper section and the lower section respectively near the ends of the baseboard (11), and each connector (30) has a connecting hook (31) formed opposite to the slide rack (10) and hung on the tool board (40). When the tool rack is set on the tool board (40), the hangers (20) may be slid along the rail (12) to hang hand tools, such as wrenches or box-end wrenches thereon.

Because the hanging shaft (22) of the hangers (20) are metal and the hanging bodies (21) for holding the inserting ends of the hanging shafts (22) are made by injection molding, the hangers (20) have reduced weight and excellent strength for hanging hand tools. Furthermore, to increase strength of the tool rack, the connecting mount (213) of each hanging body (21) is shaped as a collar extending toward the bent end of the hanging shaft (22) and mounted securely around the inserting end of the hanging shaft (22).

Figure 6:
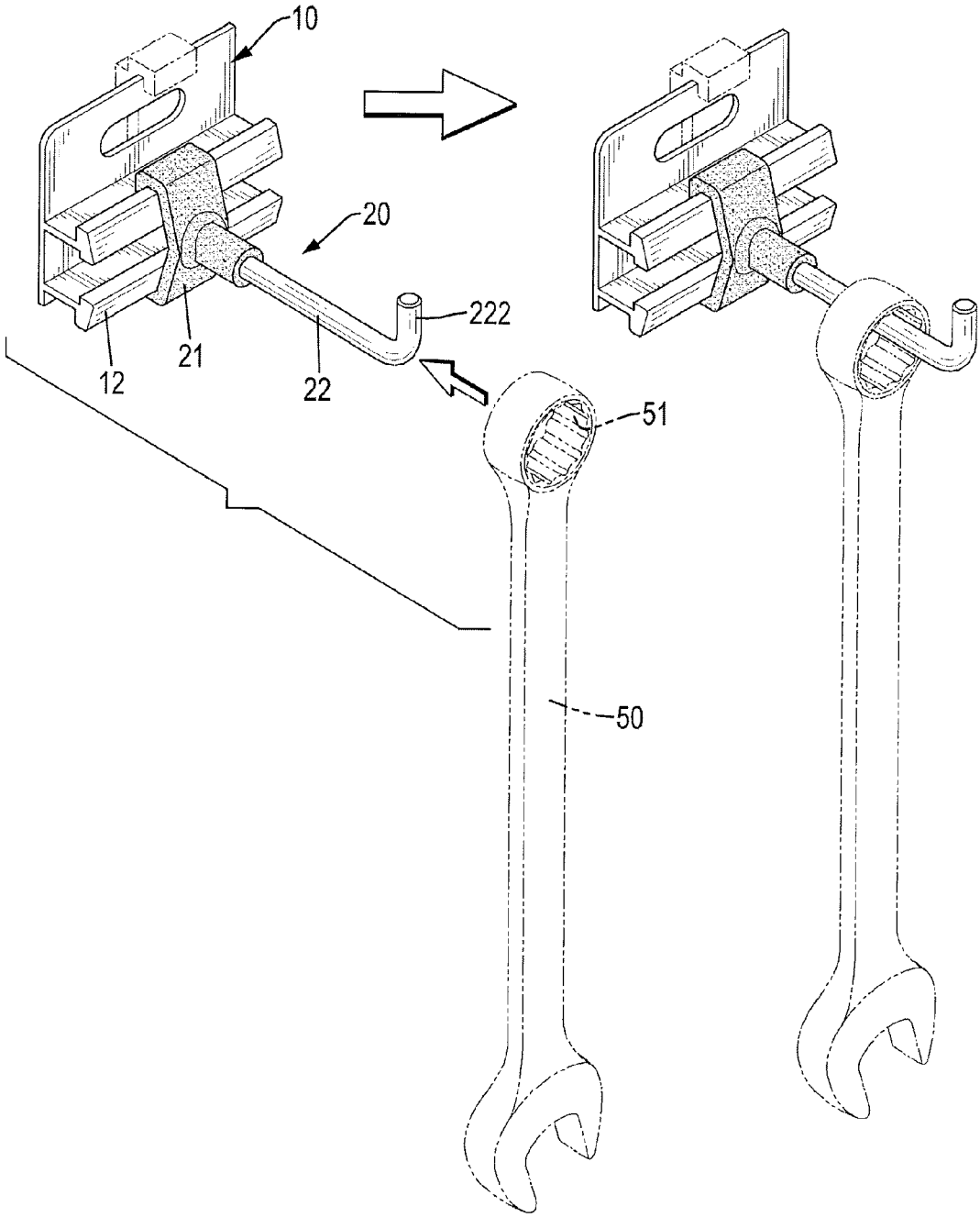
FIG. 6 shows operational perspective views of the tool rack in FIG. 1 for hanging a wrench.
Figure 7:
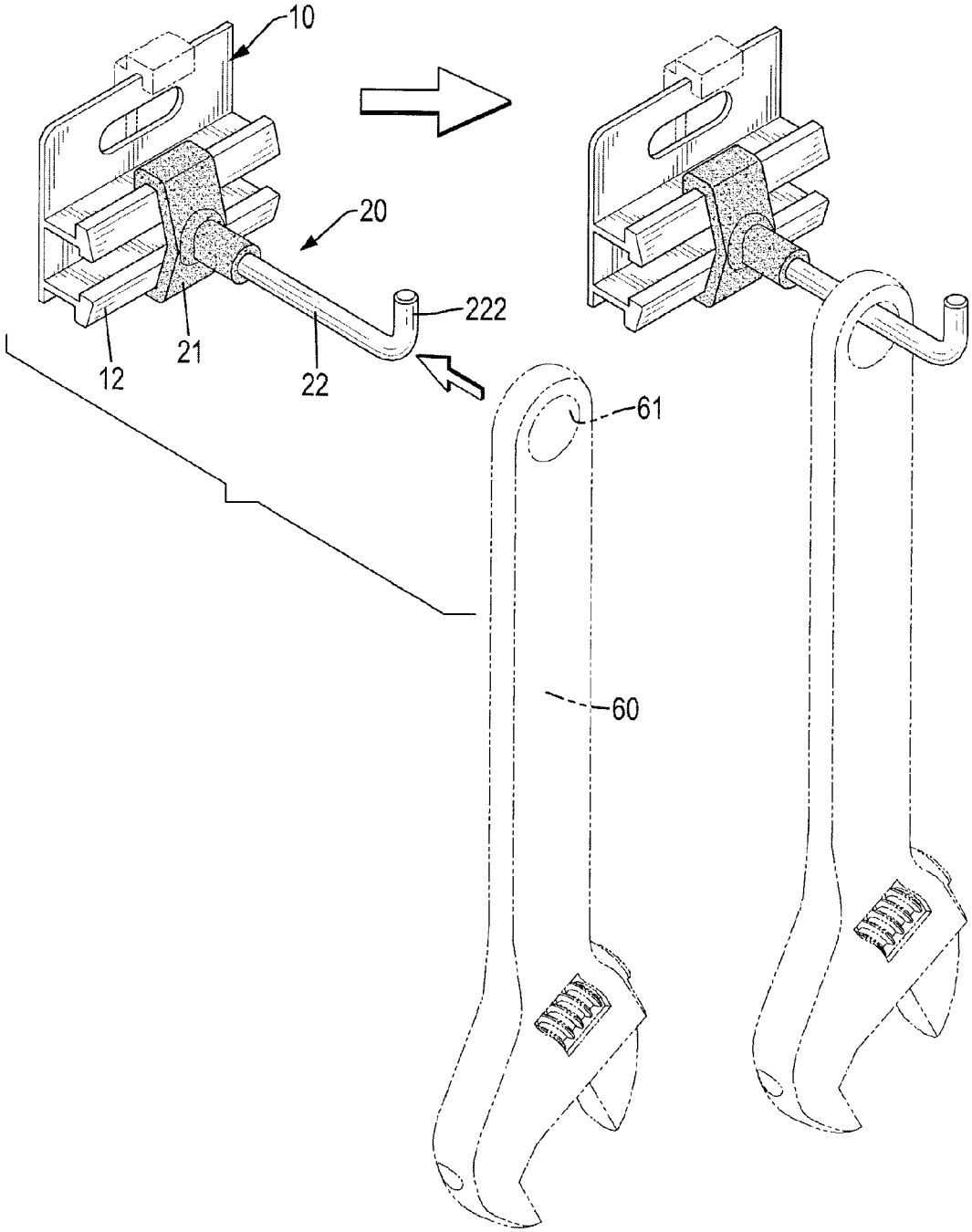
FIG. 7 shows operational perspective views of the tool rack in FIG. 1 for hanging an adjustable wrench.

With reference to FIG. 6 and FIG. 7, when the first embodiment of the tool rack is in use, a wrench head (51) of a wrench (50) or a hanging hole (61) of an adjustable wrench may be mounted on and around the hanging shaft (22) of one of the hangers (20). Because the hanging shaft (22) of each hanger (20) is metal and has an excellent structural strength to connect to the hanging body (21), the hanging shaft (22) provides sufficient strength to hold large or heavy hand tools even when the hanging shaft (22) is prolonged or reduced in diameter.

Figure 8:
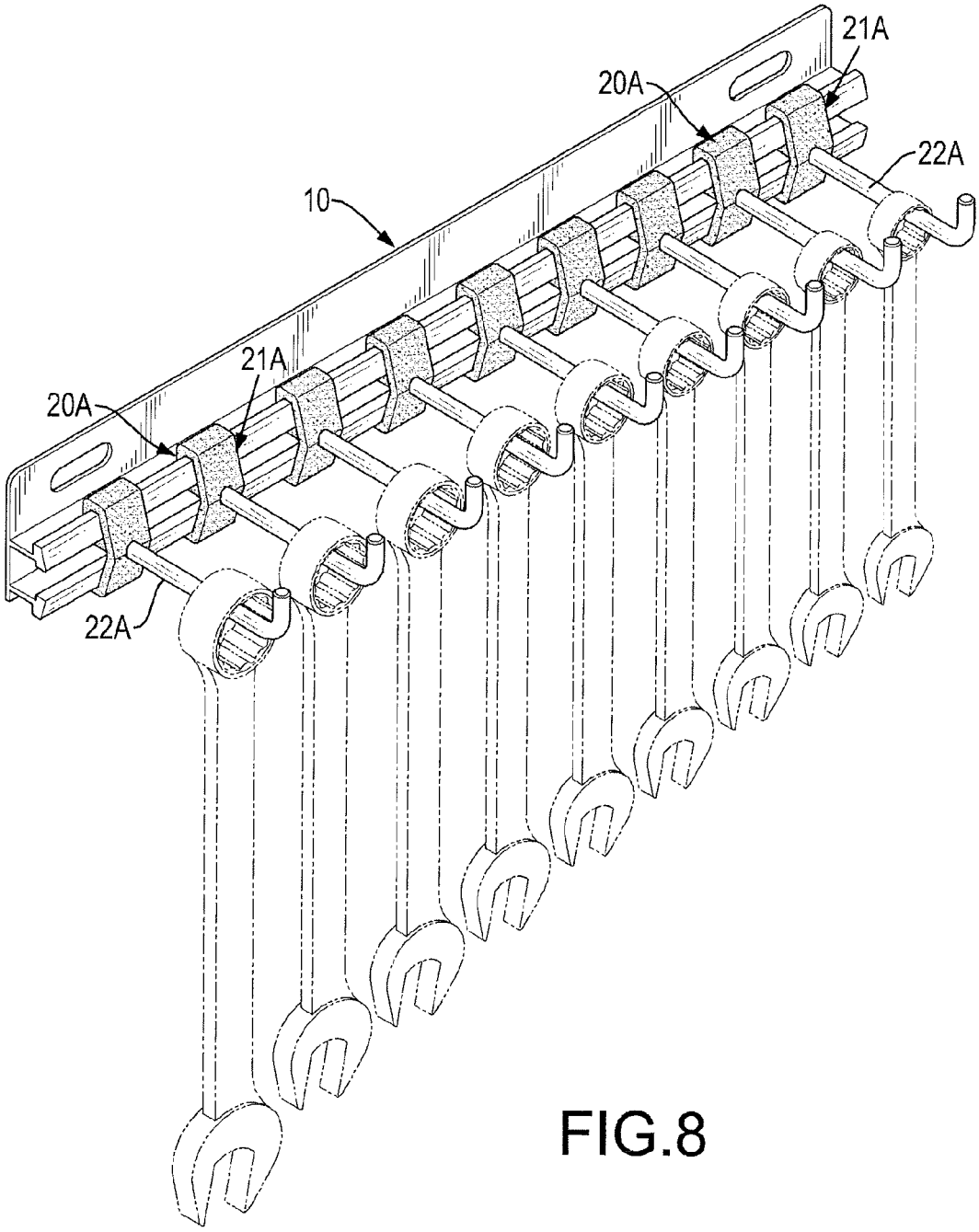
FIG. 8 is a perspective view of a second embodiment of a tool rack in accordance with the present invention.
Figure 9:
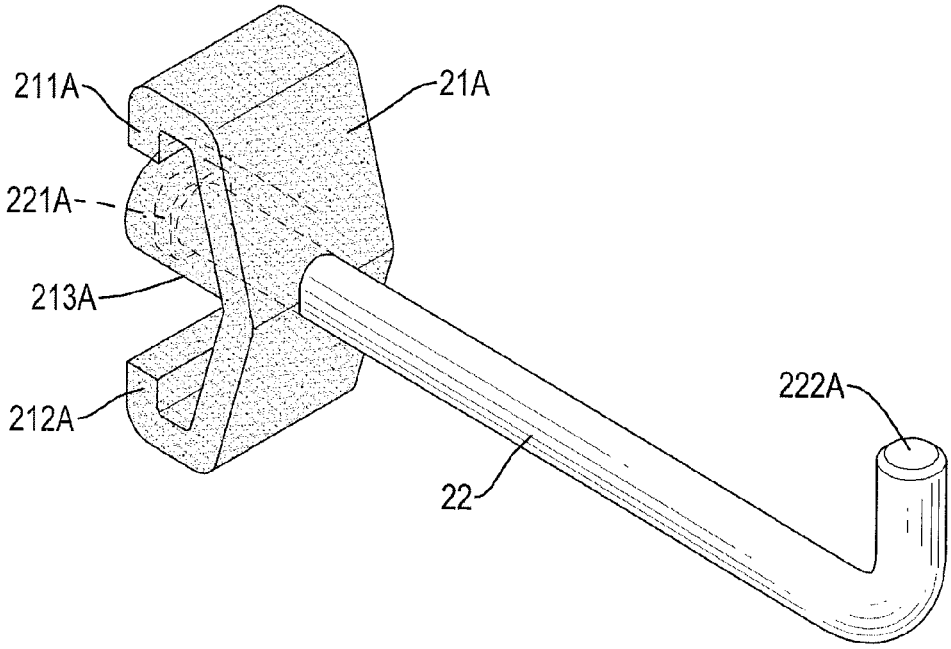
FIG. 9 is a perspective view of a hanger of the tool rack in FIG. 8.
Figure 10:
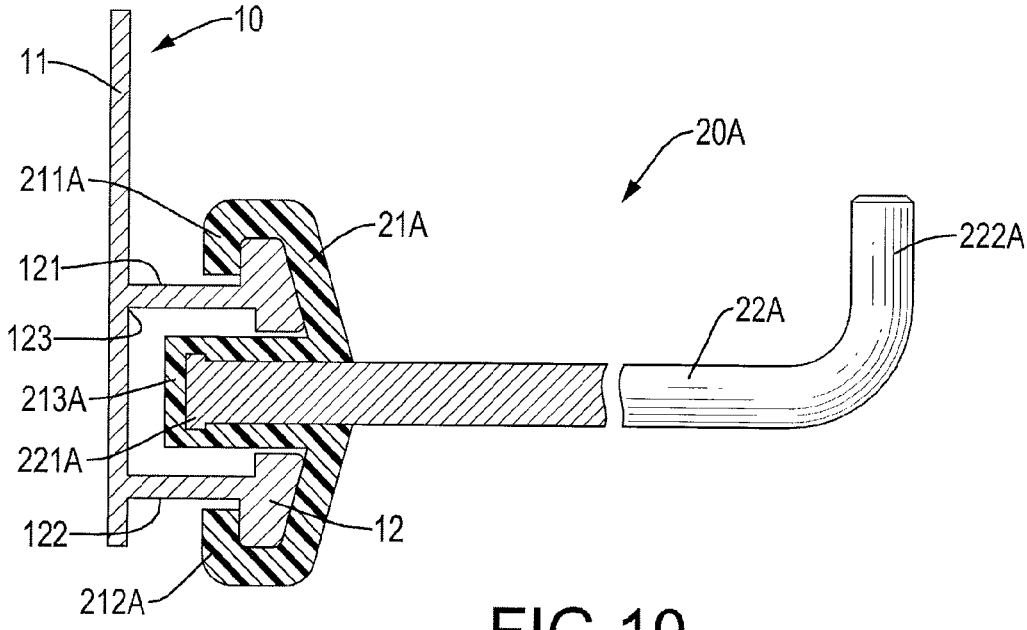
FIG. 10 is a side view in partial section of the tool rack in FIG. 8.

With reference to FIGS. 8 to 10, the second embodiment of a tool rack in accordance with the present invention differs from the first embodiment in the shapes of the hangers (20A). In the second embodiment, each hanger (20A) has a hanging body (21A) and a hanging shaft (22A). The hanging body (21A) is made by injection molding, is connected slidably to the rail (12), and has two hooking arms (211A, 212A), a protruding side, an outer side and a connecting mount (213A).

The hooking arms (211A, 212A) respectively and slidably engage the engaging ribs of the arms (121,122) of the rail (12) to hold the hanging body (21A) movably on the slide rack (10). The protruding side of the hanging body (21A) faces the slide rack (10), and may be an inner side of the hanging body (21A). The outer side of the hanging body (21A) is opposite to the protruding side and the slide rack (10). The connecting mount (213A) protrudes from the protruding side of the hanging body (21A), extends into the space (123), may be a hollow rod and extend an axial length along the rod, and has an inserting hole and an engaging recess. The inserting hole is a blind hole formed in the connecting mount (213A) through the outer side of the hanging body (21A). The engaging recess is rectangular and formed in the connecting mount (213A) and communicates with the inserting hole of the connecting mount (213A).

The hanging shaft (22A) of each hanger (20A) is metal and has an inserting end and a bent end. The inserting end of the hanging shaft (22A) is mounted in and surrounded and covered completely by the connecting mount (213A) through the outer side and the protruding side of the hanging body (21A), and has an engaging head (221A). The engaging head (221A) is mounted on the inserting end of the hanging shaft (22A) and shaped as a cube or a cuboid and has an outer diameter larger than a diameter of the inserting end of the holding shaft (22). The engaging head (221A) is mounted in the engaging recess of the connecting mount (213A) and provide an engaging effect for the hanging shaft (22A) connected securely to the hanging body (21) to prevent movement or rotation of the hanging shaft (22A) relative to the hanging body (21A). The bent end of the hanging shaft (22A) is opposite to the inserting end, and has a hook (222A) bent upward for hanging a hand tool.

Figure 11:
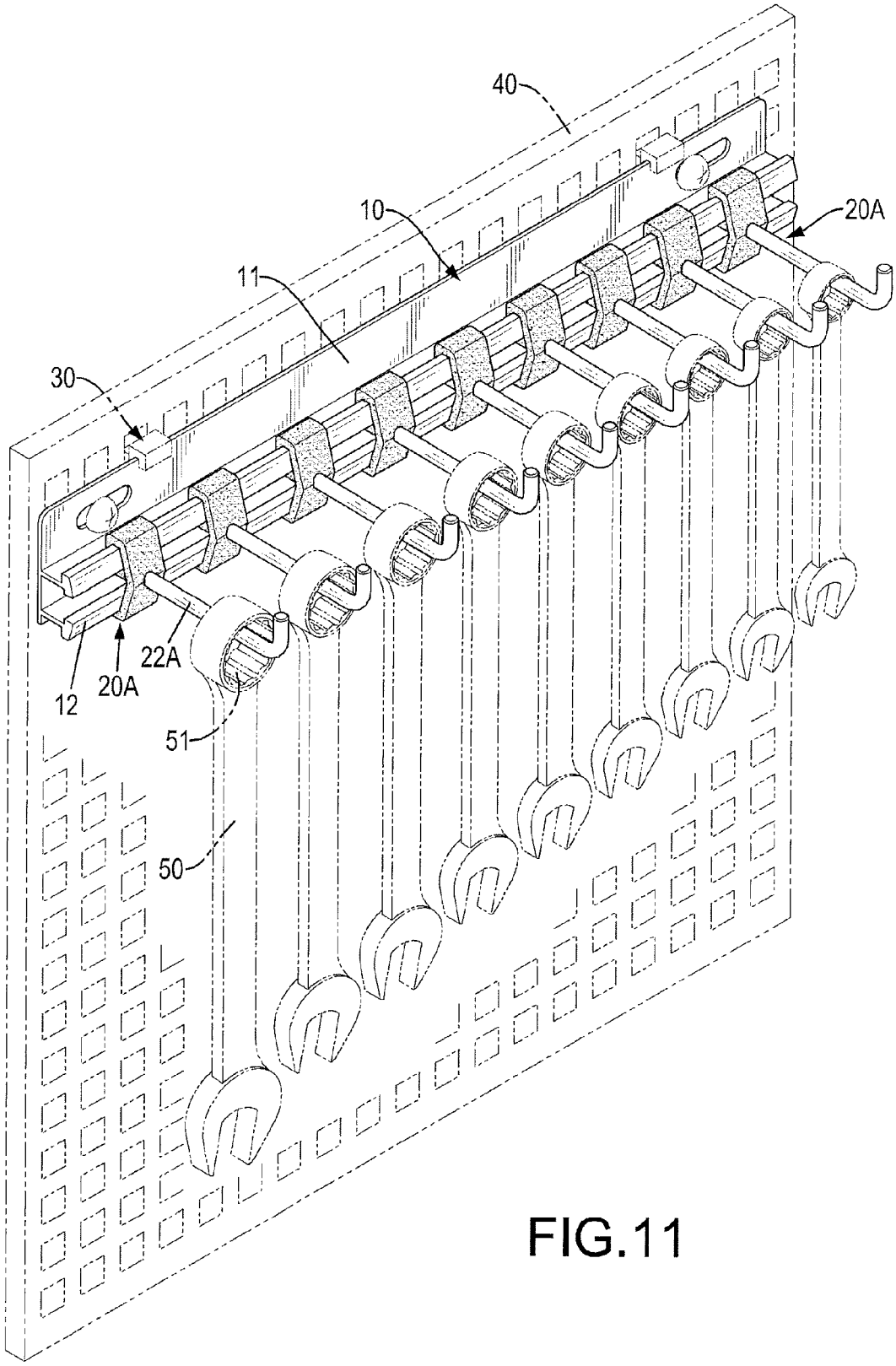
FIG. 11 is a perspective view of the tool rack in FIG. 8 shown attached to a tool board.
Figure 12:
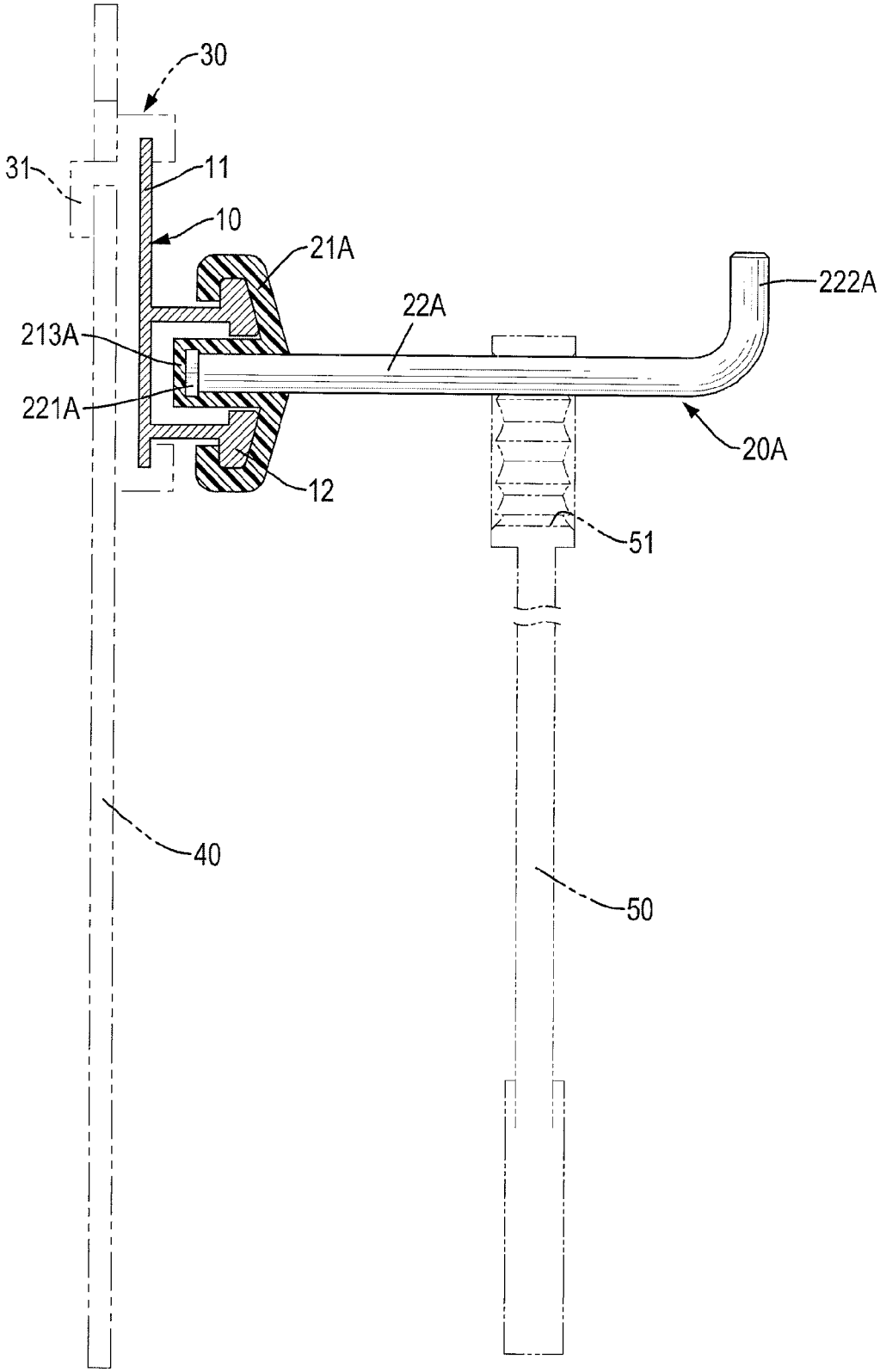
FIG. 12 is a side view in partial section of the tool rack in FIG. 11.

With reference to FIG. 11 and FIG. 12, the tool rack of the second embodiment is used in a similar way to the first embodiment.

Furthermore, the second embodiment of the tool rack has the hanging shafts (22A) respectively mounted in the inserting holes of the connecting mounts (213A) through the outer side and the protruding side of the hanging bodies (21A) to provide further enhanced strength.

Figure 13:
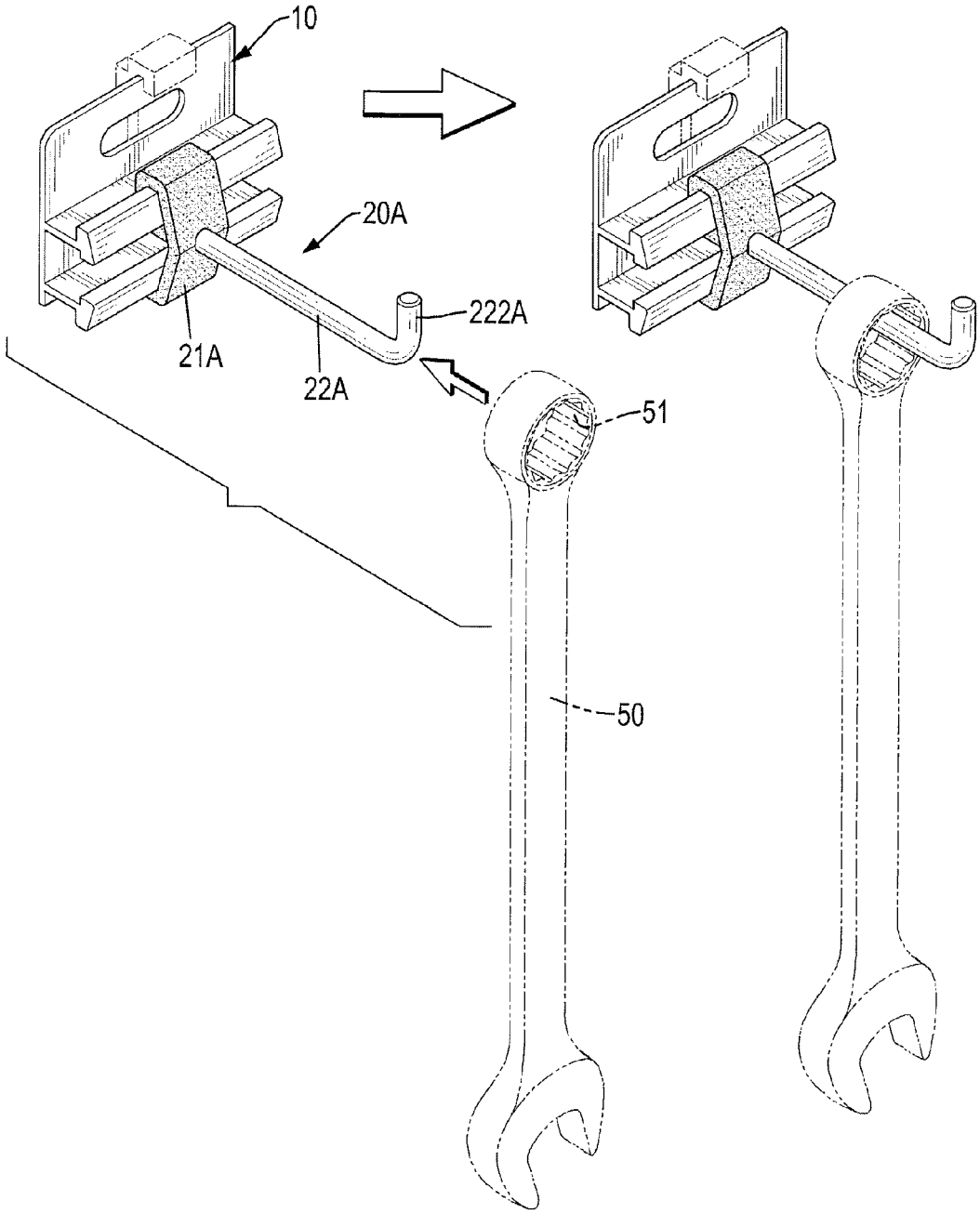
FIG. 13 shows operational perspective views of the tool rack in FIG. 8 for hanging a wrench.
Figure 14:
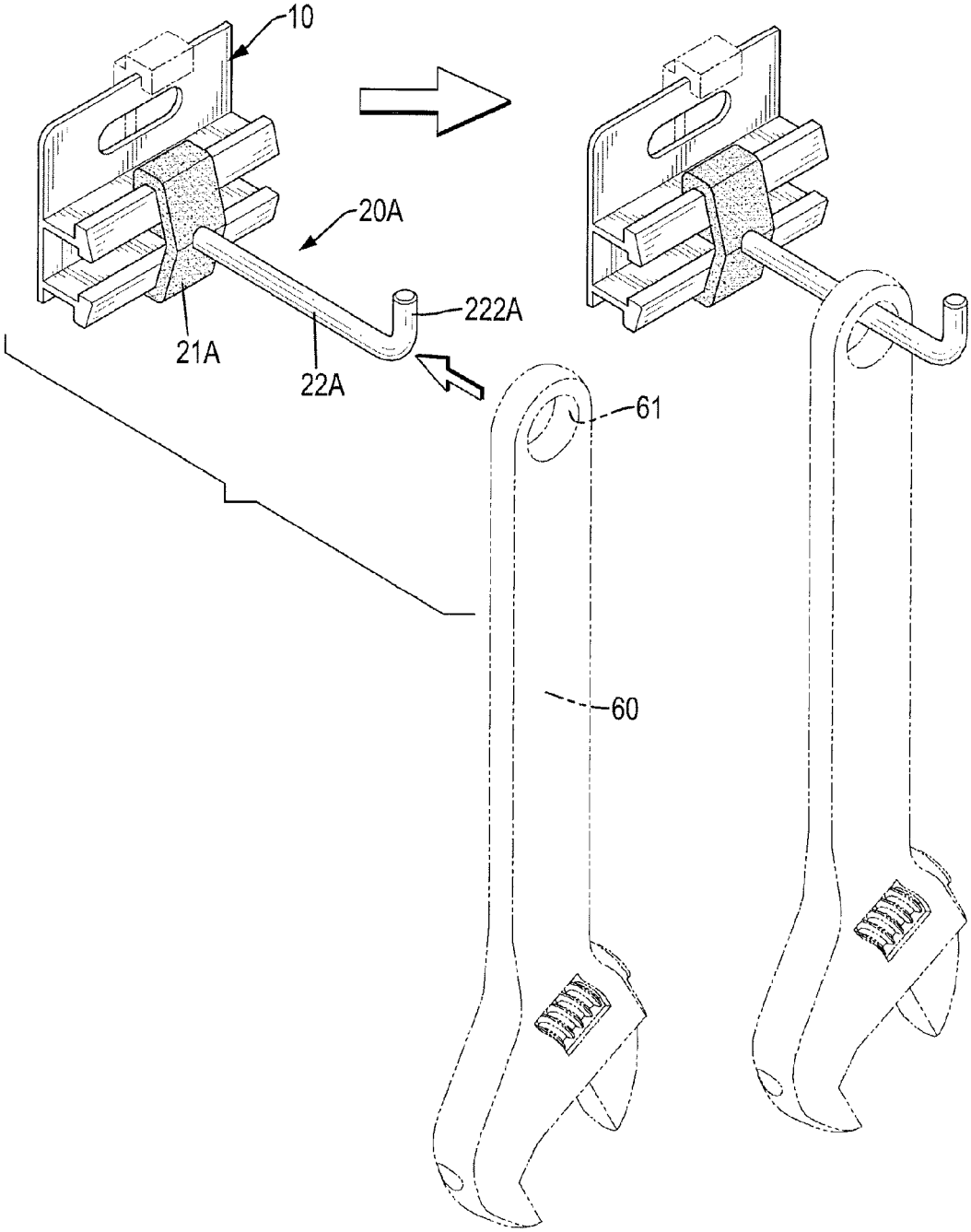
FIG. 14 shows operational perspective views of the tool rack in FIG. 8 for hanging an adjustable wrench.

With reference to FIG. 13 and FIG. 14, when the second embodiment of the tool rack is in use, a wrench head (51) of a wrench (50) or a hanging hole (61) of an adjustable wrench may be mounted on and around the hanging shaft (22A) of the hanger (20A). Because the hanging shaft (22A) of each hanger (20) is metal and has excellent structural strength to connect to the hanging body (21), the hanging shaft (22) provides sufficient strength to hold a large or heavy hand tool even when the hanging shaft (22) is prolonged or reduced in diameter.

Figure 15:
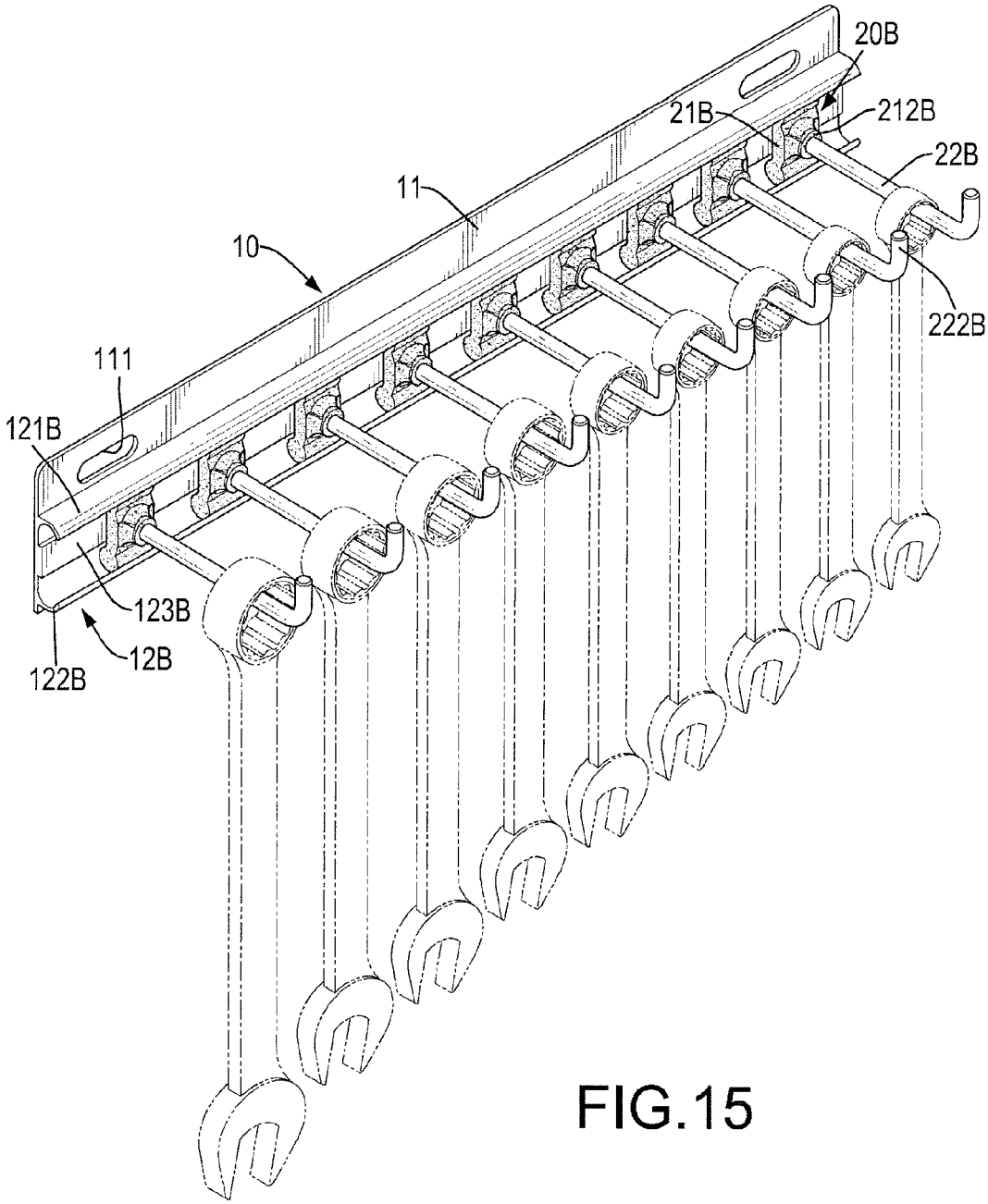
FIG. 15 is a perspective view of a third embodiment of a tool rack in accordance with the present invention.
Figure 16:
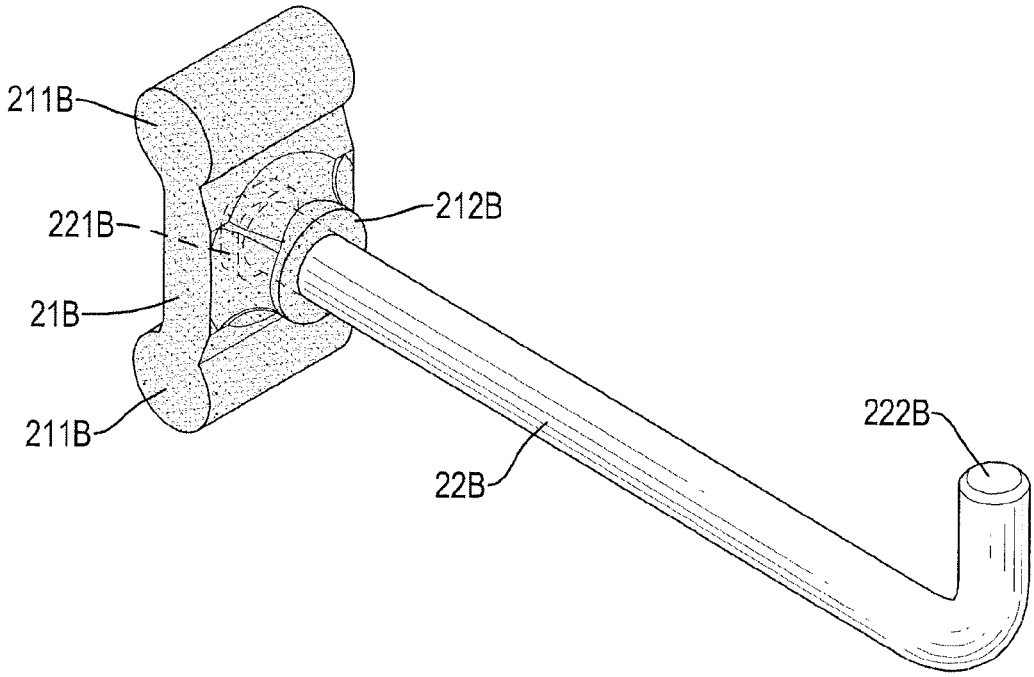
FIG. 16 is a perspective view of a hanging head of the tool rack in FIG. 15.
Figure 17:
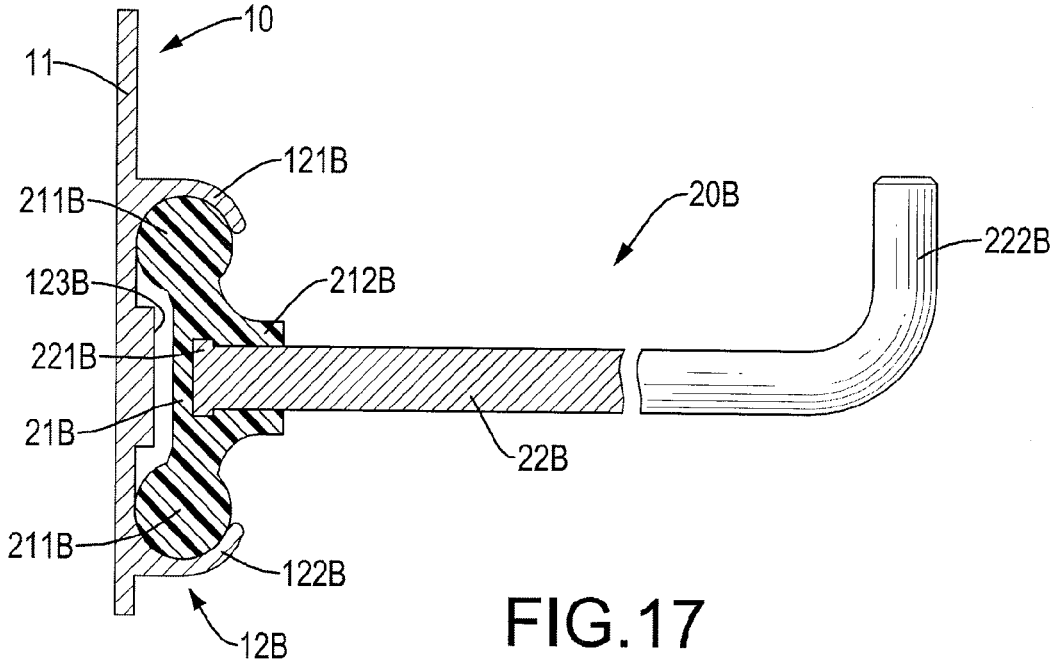
FIG. 17 is a side view in partial section of the tool rack in FIG. 15.

With reference to FIGS. 15 to 17, the third embodiment of a tool rack in accordance with the present invention differs from the first and second embodiments in the shapes of the arms (121B,122B) and the space (123B) of the rail (12B) and the hanging body (21B) of each hanger (20B).

In the third embodiment, the arms (121B,122B) of the rail (12B) protrude from the lower section of the baseboard (11), are respectively bent to each other and each has a concave curved inner surface facing to the other. The space (123B) is defined between the arms (121B,122B) to contain the hanging bodies (21B) of the hangers (20B).

The hanging body (21B) of each hanger (20B) is made by injection molding, is connected slidably to the rail (12B) of the slide rack (10), mounted in the space (123B) between the arms (121B,122B) of the rail (12B), and has a top, a bottom, two engaging rods (211B), a protruding side and a connecting mount (212B). The engaging rods (211B) are respectively formed on the top and the bottom of the hanging body (21B) along the rail (12B), and may be two cylinders or each have a convex corresponding to the concave curved inner surface of the arms (121B,122B).

The protruding side of the hanging body (21B) is opposite to the slide rack (10) and may have an outer side opposite the protruding surface. The connecting mount (212B) protrudes from the protruding side of the hanging body (21B) and extends out the rail (12B), and may be a hollow rod and extended an axial length along the rod, and has an inserting hole and an engaging recess. The inserting hole is formed in the connecting mount (212B) through the protruding side of the hanging body (21B). The engaging recess is rectangular and formed in the connecting mount (212B) and communicates with the inserting hole of the connecting mount (212B).

The engaging head (221B) of the inserting end of the shaft (22B) is mounted in the engaging recess of the connecting mount (212B) and provides an engaging effect for the hanging shaft (22B) connected securely to the hanging body (21B). The bent end of the hanging shaft (22B) is opposite to the inserting end, and has a hook (222B) bent upward for hanging a hand tool.

Figure 18:
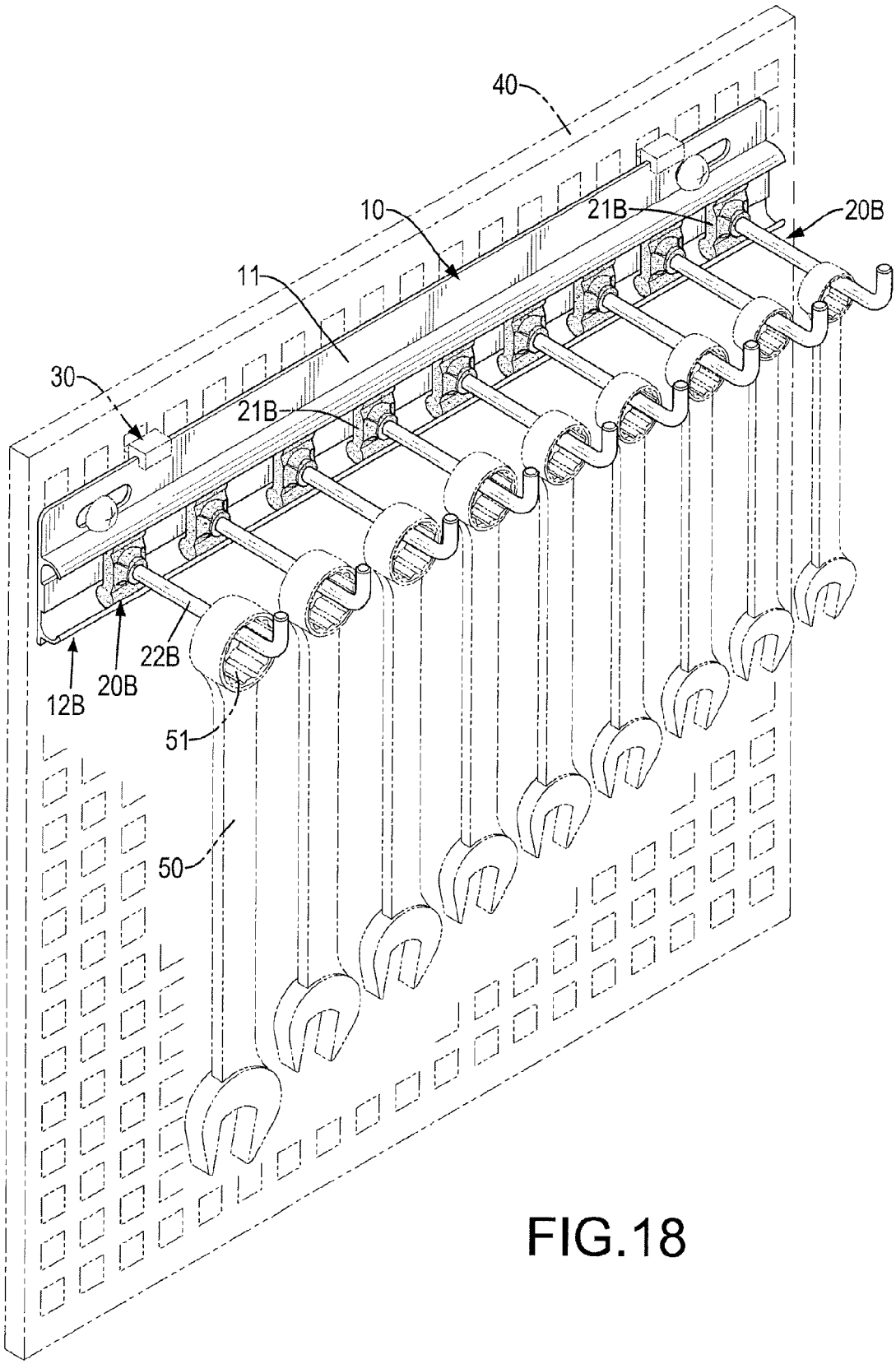
FIG. 18 is a perspective view of the tool rack in FIG. 15 shown attached to a tool board.
Figure 19:
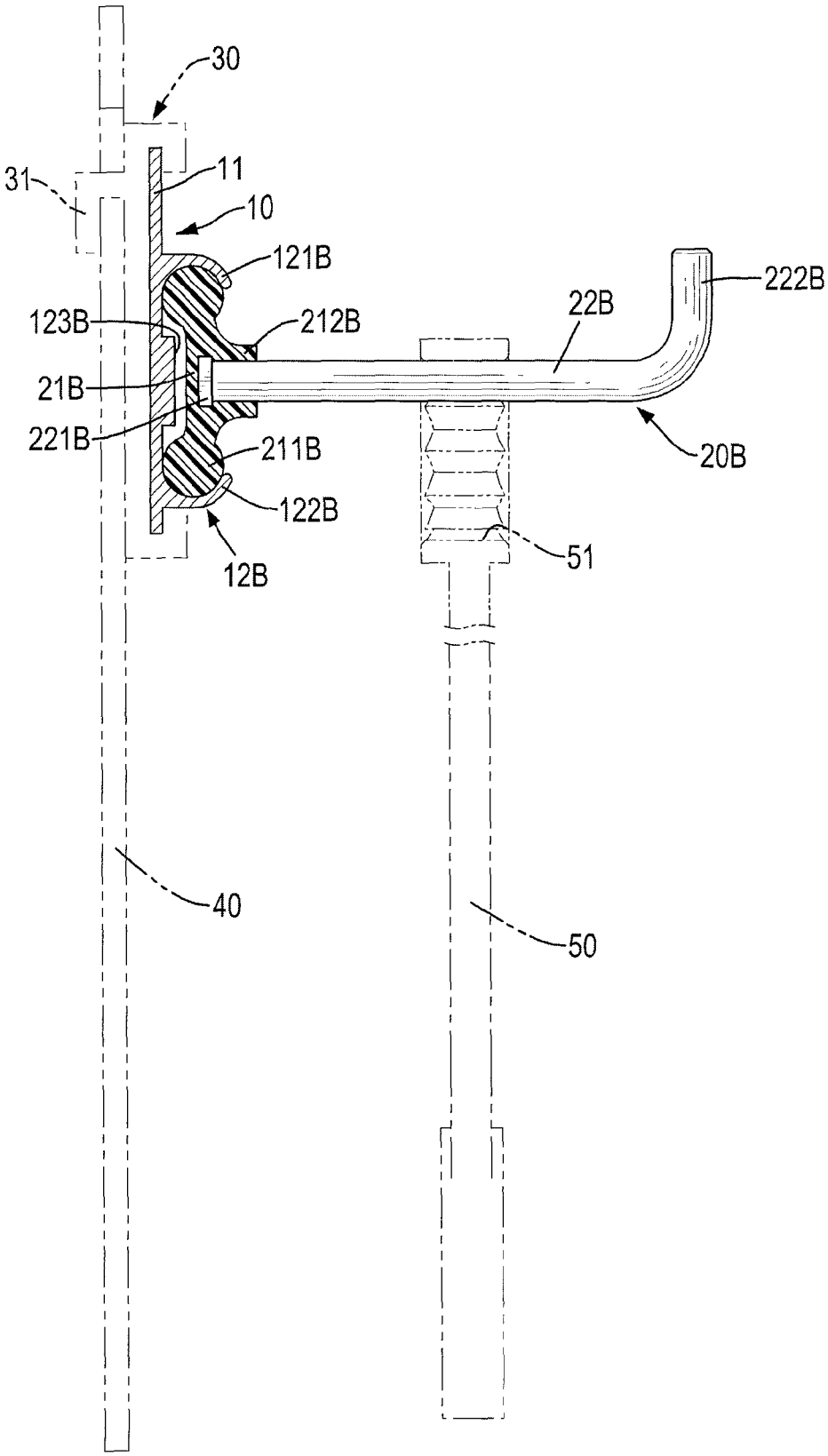
FIG. 19 is a side view in partial section of the tool rack in FIG. 18.

With reference to FIG. 18 and FIG. 19, the tool rack of the third embodiment is used in a similar way to the first and second embodiments. Furthermore, the hanging bodies (12B) of the hangers (20B) are respectively slidably mounted in and contained in the space (123B) of the rail (12B) of the slide rack (10) and provide movement of sliding along the rail (12B).

Figure 20:
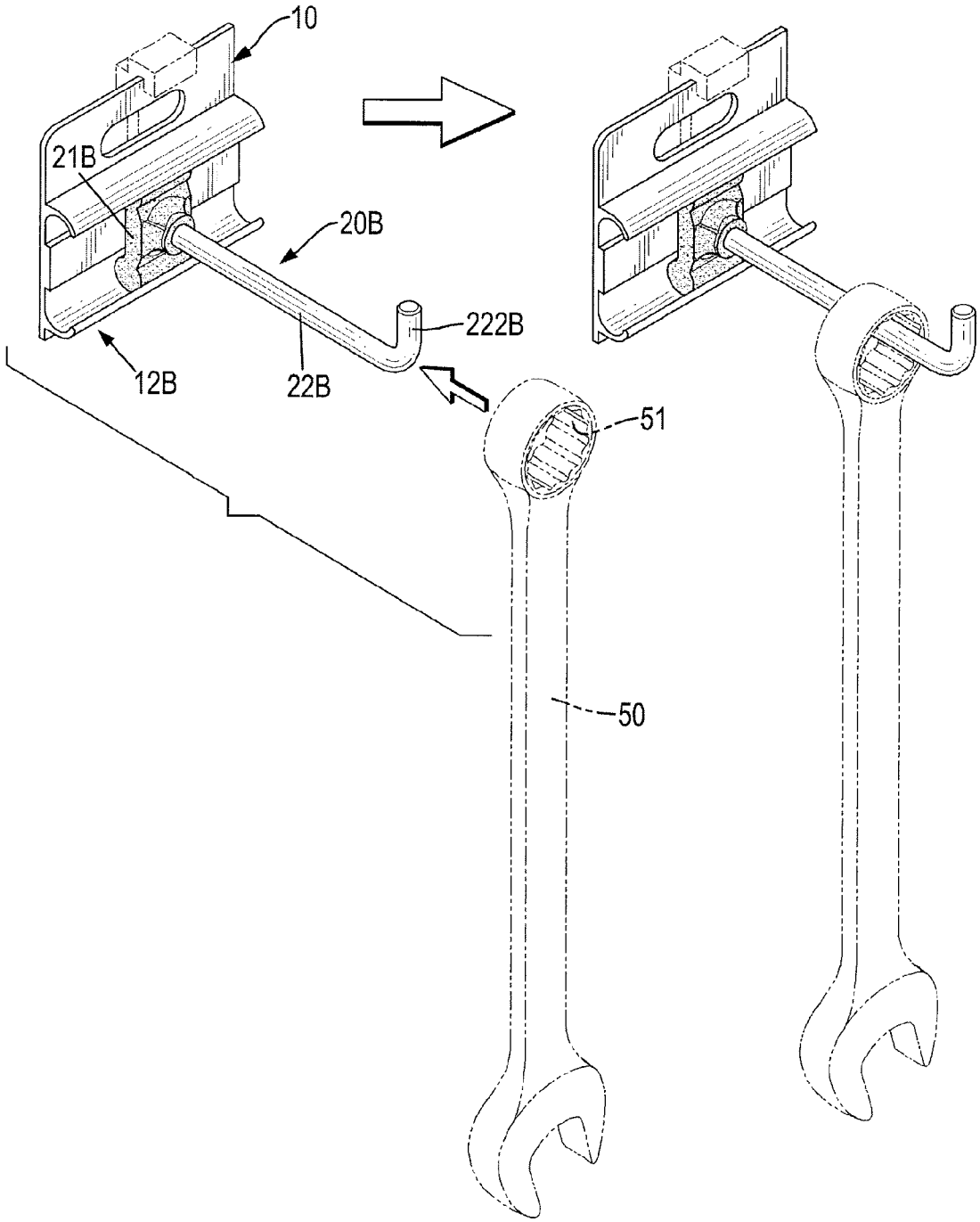
FIG. 20 shows operational perspective views of the tool rack in FIG. 15 shown attached to a tool board.
Figure 21:
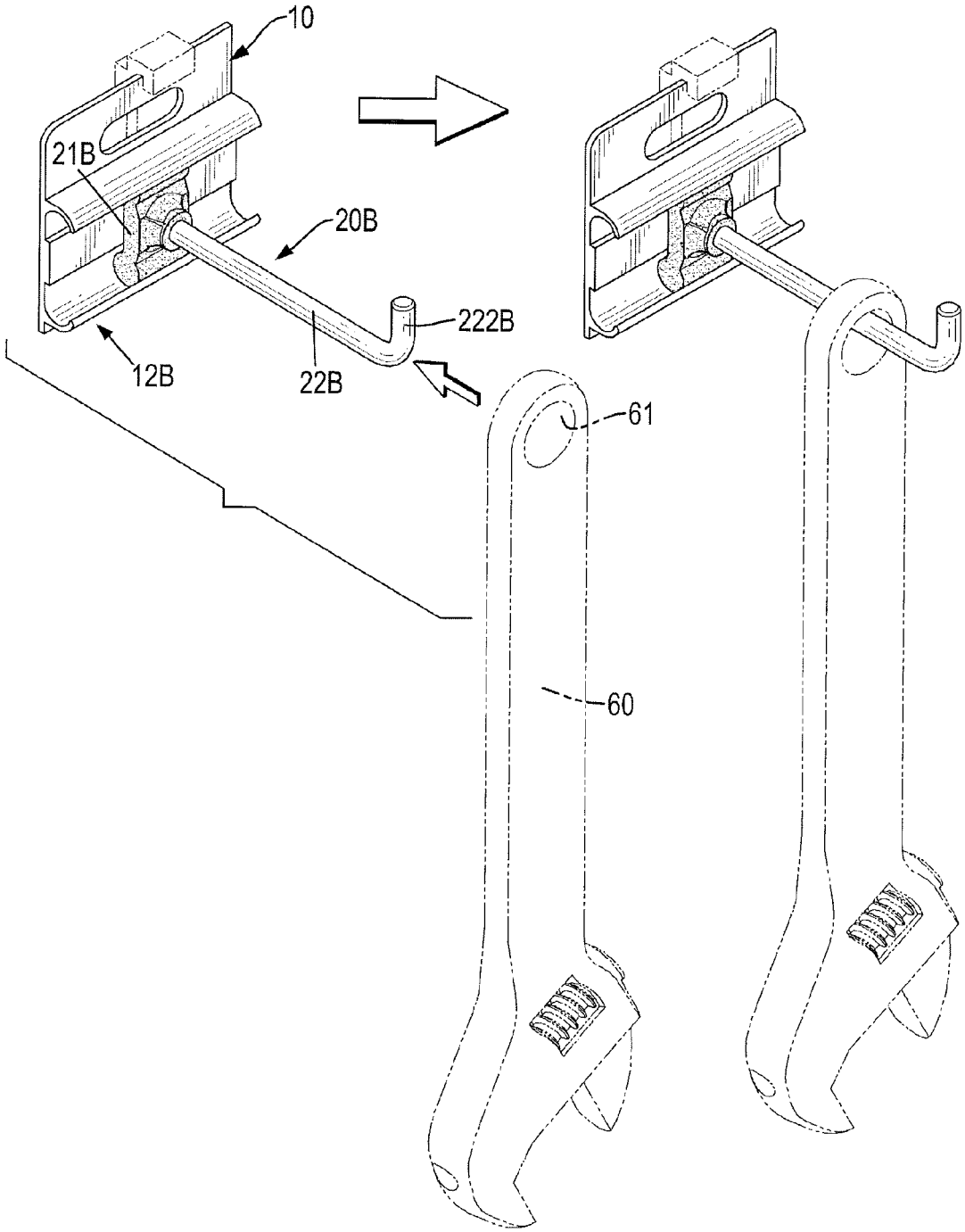
FIG. 21 shows operational perspective views of the tool rack in FIG. 15 for hanging an adjustable wrench.

With reference to FIG. 20 and FIG. 21, when the third embodiment of the tool rack is in use, a wrench head (51) of a wrench (50) or a hanging hole (61) of an adjustable wrench may be mounted on and around the hanging shaft (22B) of the hanger (20B). Because the hanging shaft (22B) of each hanger (20B) is metal and has an excellent structural strength to connect to the hanging body (21B), the hanging shaft (22B) provides sufficient strength to hold a large or heavy hand tool even when the hanging shaft (22B) is prolonged or reduced in diameter.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tool rack comprising
a slide rack having
a baseboard; and
a rail protruding from the baseboard;
multiple hangers slidably mounted on the rail of the slide rack and each having
a hanging body made by injection molding and slidably connected to the rail of the slide rack and having
a protruding side defined on the hanging body; and
a connecting mount being a rod protruding from the protruding side of the hanging body and extending an axial length along the rod and having
an inserting hole being a blind hole formed in the connecting mount; and
an engaging recess formed in the connecting mount and communicating with the inserting hole of the connecting mount; and
a hanging shaft made of metal and having
an inserting end mounted in the inserting hole and surrounded and covered completely by the connecting mount having
an engaging head formed on the inserting end of the hanging shaft and mounted in the engaging recess of a corresponding connecting mount and having an outer diameter larger than a diameter of the inserting end of the holding shaft; and
a bent end opposite to the inserting end and having a hook bent upward for hanging a hand tool.

2. The tool rack as claimed in claim 1, wherein
the hanging bodies of the hangers are respectively slidably mounted on the rail of the slid rack;
the protruding sides of hanging bodies are opposite to the slide rack; and
each connecting mount protruding toward the bent end of the hanging shaft which is mounted in the connecting mount.

3. The tool rack as claimed in claim 1, wherein
the baseboard is elongated;
the rail has
two arms respectively protruding from the baseboard, and each having
an engaging end opposite to the baseboard and having a thickness; and
an engaging rib formed on the engaging end and having a thickness thicker than the thickness of the engaging end; and
a space defined between the arms;
each hanging body further has an outer side opposite to the protruding side and two hooking arms respectively and slidably engaged the engaging ribs of the arms;
the hanging bodies of the hangers are respectively slidably mounted on the rail of the slid rack; and
the protruding sides of the hanging bodies face to the slide rack;
the connecting mounts of the hanging bodies respectively protrude from the protruding sides of the hanging bodies and extend into the space of the rail; and
the inserting ends of the hanging shafts are respectively mounted through the outer sides and the protruding sides of the hanging bodies and are mounted in and surrounded by the connecting mounts of the hanging bodies.

4. The tool rack as claimed in claim 1, wherein
the baseboard is elongated;
the rail has
two arms respectively protruding from the baseboard and bent to each other;
a space defined between the arms;
each hanging body is mounted slidably in the space between the arms of the rail and further has an outer side opposite to the protruding side;
the protruding sides of the hanging bodies face to the slide rack;
the connecting mounts of the hanging bodies respectively protrude from the protruding sides of the hanging bodies and extending into the space of the rail; and
the inserting ends of the hanging shafts are respectively mounted through the outer sides and the protruding sides of the hanging bodies and are mounted in and surrounded by the connecting mounts of the hanging bodies.

5. The tool rack as claimed in claim 4, wherein
the arms of the rail respectively have a concave curved inner surface facing the other; and
each hanging body further has
a top;
a bottom; and two engaging rods respectively formed on the top and the bottom of the hanging body along the rail, and each rod having a convex corresponding to the concave curved inner surface of a corresponding one of the arms of the rail.

6. The tool rack as claimed in claim 1, wherein the engaging head is shaped as a cuboid.

7. The tool rack as claimed in claim 2, wherein the engaging head is shaped as a cuboid.

8. The tool rack as claimed in claim 3, wherein the engaging head is shaped as a cuboid.

9. The tool rack as claimed in claim 4, wherein the engaging head is shaped as a cuboid.

10. The tool rack as claimed in claim 5, wherein the engaging head is shaped as a cuboid.

11. The tool rack as claimed in claim 1, wherein the baseboard is an elongated rectangular board and further has a front;

an upper section;

a lower section;

two ends; and two holes respectively formed through and defined near the ends at the upper section of the baseboard; and the rail is formed on and protrudes from the front and the lower section of the baseboard.

12. The tool rack as claimed in claim 10, wherein the baseboard is an elongated rectangular board and further has a front;

an upper section;

a lower section;

two ends; and two holes respectively formed through and defined near the ends at the upper section of the baseboard; and the rail is formed on and protrudes perpendicularly from the front and the lower section of the baseboard.

* * * * *